US008916027B2

(12) United States Patent
Wicher

(10) Patent No.: US 8,916,027 B2
(45) Date of Patent: Dec. 23, 2014

(54) PREPREG

(75) Inventor: Martina Wicher, Bissendorf (DE)

(73) Assignee: Schoeller Technocell GmbH & Co. KG, Osnabruck (DE)

( * ) Notice: Subject to any disclaimer, the term of this patent is extended or adjusted under 35 U.S.C. 154(b) by 0 days.

(21) Appl. No.: 13/529,781

(22) Filed: Jun. 21, 2012

(65) Prior Publication Data

US 2012/0325418 A1 Dec. 27, 2012

(30) Foreign Application Priority Data

Jun. 22, 2011 (DE) ..... 10 2011 105 676

(51) Int. Cl.
*D21H 27/26* (2006.01)
*B44C 5/04* (2006.01)

(52) U.S. Cl.
CPC ..... *B44C 5/0469* (2013.01); *D21H 27/26* (2013.01)
USPC ..... 162/168.7; 162/175

(58) Field of Classification Search
CPC ..... D21H 17/37; D21H 17/375; D21H 27/26; D21H 27/28; B44C 5/04
USPC ..... 162/168.1, 168.7, 175, 135, 137; 428/503, 511–513, 534, 535, 537.5
See application file for complete search history.

(56) References Cited

U.S. PATENT DOCUMENTS

| | | | | | |
|---|---|---|---|---|---|
| 3,551,283 | A | * | 12/1970 | Kelly et al. | 428/506 |
| 3,567,118 | A | * | 3/1971 | Shepherd et al. | 239/6 |
| 3,813,267 | A | * | 5/1974 | Honjo | 156/236 |
| 3,992,338 | A | * | 11/1976 | Noyes | 525/7.3 |
| 4,389,451 | A | * | 6/1983 | Fujioka et al. | 428/212 |
| 5,098,952 | A | * | 3/1992 | Blasko et al. | 525/123 |
| 2010/0170648 | A1 | * | 7/2010 | Elizalde et al. | 162/135 |
| 2010/0183890 | A1 | * | 7/2010 | Wicher | 428/514 |

FOREIGN PATENT DOCUMENTS

| | | | |
|---|---|---|---|
| DE | 196 12 483 | A1 | 5/1997 |
| DE | 100 46 770 | A1 | 2/2002 |
| DE | 10 2005 005205 | A1 | 8/2006 |
| JP | 52-118015 | * | 10/1977 |
| JP | 9-12966 | * | 6/1995 |
| JP | 09-012966 | | 1/1997 |
| JP | 2000-219856 | * | 8/2000 |
| JP | 2005-330399 | * | 12/2005 |
| JP | 2005330399 | | 12/2005 |

* cited by examiner

*Primary Examiner* — Eric Hug
(74) *Attorney, Agent, or Firm* — Honigman Miller Schwartz and Cohn LLP; Thomas A. Wootton; Jonathan P. O'Brien

(57) ABSTRACT

A prepreg for further processing to form a decorative paper is obtainable by impregnation of a decorative base paper with an impregnating resin solution that contains at least one styrene-alkylacrylate-hydroxyethylmethacrylate copolymer and at least one water-soluble polymer, wherein alkyl stands for methyl, ethyl, propyl, or butyl and the prepreg is notable for improved resistance to splitting as well as better adhesion and flatness.

17 Claims, No Drawings

PREPREG

CROSS-REFERENCE TO RELATED APPLICATIONS

This application claims priority under 35 U.S.C. 119 to German Application No. DE 10 2011 105 676.2, which is incorporated herein by reference in its entirety.

TECHNICAL FIELD OF THE INVENTION

This invention relates to pre-impregnates and decorative impregnates or decorative coating materials obtainable therefrom.

BACKGROUND OF THE INVENTION

Decorative coating materials, also referred to as decorative papers or decorative foils are primarily used as a surface coating in furniture manufacturing and interior fittings, particularly laminate floors. Decorative paper/decorative foil is understood to be printed or unprinted papers that have either been impregnated with synthetic resin or impregnated with synthetic resin and undergone surface treatment. Decorative papers/decorative foils are glue-bonded or adhesive-bonded to a backing panel.

Depending on the type of impregnation operation, a distinction is made between decorative papers/decorative foils with a thoroughly impregnated paper core, and "prepregs", in which the paper is only partially impregnated online or offline in the paper machine None of the previously known prepregs, which contain formaldehyde-containing duroplastic resins or acrylate-containing binders that are low in formaldehyde, satisfies all of the requirements placed on it, such as good plybond strength and good adhesion after it has been painted and stuck to a wood-based sheet material board.

In order to bond the decorative foils to wood materials such as chipboard or MDF board, the adhesives normally used are urea-based glues or polyvinyl acetate (PVAC) glues. These do not always guarantee that the decorative foils will be bonded properly.

High pressure laminates are laminates that are produced by compressing a number of impregnated, stacked papers against each other. The structure of these laminates generally includes an uppermost, transparent covering sheet (the overlay), which provides high surface resistance, a resin-impregnated decorative paper, and one or more kraft paper sheets impregnated with phenolic resin. The base (substratum) may be formed by hardboard and chipboard panels or plywood for example.

In the laminates produced according to the short cycle process (low pressure laminates), the decorative paper soaked in resin is pressed directly against a base, for example a chipboard, with the application of low pressure.

In the processing industry, very high demands are placed on the bondability and adhesion of the glued decorative foil. For example, adhesion must be good immediately after the gluing process, in order to prevent the freshly laminated panel from being damaged by further handling. The panels are often machined further just a few minutes to hours after the decorative foil is glued on, in sawing, milling and drilling processes, and the applied decorative foil must not separate or tear at the machined edges. The finished surfaces are often packaged for further transport as well, and adhesive tapes are used for this, being affixed directly to the decorative surface. These adhesive tapes must have sufficient adhesive strength, but they must be removable without residue and without damaging the decorative foil to which they stick after transporting operations are complete. The decorative foil must therefore have high plybond strength perpendicularly to the decorative surface after it has been glued as well.

The decorative paper used in the coating materials described in the preceding is used in the white or coloured state and with or without additional printing.

With regard to their technical application properties the decorative base papers that are used as the starting materials must satisfy certain requirements. These include high opacity for better coverage of the base, uniform formation and grammage of the sheet for homogeneous resin absorption, a high degree of resistance to light, high purity and colour evenness for good reproducibility of the pattern to be printed, wet strength to ease the impregnation process, corresponding absorbency to achieve the required degree of resin saturation, dry strength, which is important in winding operations in the paper machine and during printing in the printing machine.

In order to achieve a decorative surface, the decorative base papers may be printed. Printing is mostly done by the rotogravure printing process, in which the printed image is transferred to the paper by means of several gravure rollers. The individual printed dots are to be transferred completely and as intensively as possible to the surface of the paper. But it is precisely in the decorative gravure printing that sometimes only a fraction of the raster points present on the gravure rollers is transferred to surface of the paper. "Missing dots", this is to say voids, occur. The printing colour often penetrates too deep into the paper structure, which in turn reduces the colour intensity. The prerequisites for a good printed image with few voids and high colour intensity are thus a paper surface topography that is as smooth as possible and balanced colour acceptance behaviour of the paper surface.

For this reason, base papers are usually smoothed with soft calenders, and in some cases also with Janus calenders. This treatment can cause the paper surface to become bruised and consequently compacted, which impairs its resin absorption capability.

The properties described in the preceding are influenced significantly by the impregnation of the decorative base paper, that is to say, by the nature of the impregnation medium used.

The impregnation resin solutions normally used for impregnating the decorative base papers are resins based on urea, melamine, or phenolic resins and containing formaldehyde, and result in brittle products with poor tear propagation resistance and printability.

In recent times, it has become more and more important to ensure that the impregnation resin solutions used for impregnating decorative base papers are free from substances that may be harmful to human health, particularly that they contain no formaldehyde. Furthermore, the components used should originate from renewable raw materials to the extent possible.

The use of a formaldehyde-free resins with a base of an acrylic acid ester styrene copolymer to produce non-yellowing prepregs is described in DE 197 28 250 A1. The disadvantage of this material is that it produces a product with poor resistance to splitting and inadequate adhesion strength after bonding.

Formaldehyde-free impregnation resin solutions for impregnating decorative base papers are also described in EP 09 648 248 A1 and EP 0 739 435 A1. These preferably consist of a styrene acrylic acid copolymer and polyvinyl alcohol. Unfortunately, the paper that is impregnated with such an impregnation resin solution is also in need of further improvement in terms of its plybond strength and adhesion after bonding.

In WO 2001/11139 A1, a formaldehyde-free compound consisting of a binding agent, an aqueous polymer dispersion and glyoxal is suggested, with which decorative papers that are highly resistant to splitting can be produced. However, the paper impregnated with this compound does not bond well.

In WO 2009/000769 A1, a formaldehyde-free compound consisting of a styrene-acrylic acid ester copolymer and a starch having a particular molecular weight distribution is described. However, the properties of this prepreg with regard to bonding after adhesion still need improvement.

SUMMARY OF THE INVENTION

The object of the application is to provide a formaldehyde-free prepreg that does not exhibit the disadvantages described in the preceding, and which is notable in particular for good adhesion after gluing to a wood based sheet material, high resistance to splitting even immediately after gluing in the wet state, good printability, and good flatness during printing and laminating.

This object is solved with a prepreg that is comprised of, or obtainable by impregnating a base paper with an impregnation resin solution that contains at least one styrene-alkyl acrylate hydroxyethyl(meth)acrylate copolymer and at least one water-soluble polymer, wherein alkyl may stand for methyl, ethyl, propyl and/or butyl, which is to say wherein alkylacrylate is selected from the group consisting of: methylacrylate, ethylacrylate, propylacrylate, or butylacrylate.

A further object of the disclosure is to provide and describe a decorative paper or decorative coating material that has been produced from the aforementioned prepreg or produced by a thoroughly impregnated paper core.

Surprisingly, it was found that the impregnation resin described herein is particularly suitable, because it not only improves the resistance to splitting and bonding after adhesion to a wood based sheet material of the papers impregnated therewith, it also enables comparably good or even better results than those of the related art with regard to other properties such as printability, varnish penetration or yellowing.

Moreover, the problems that normally arise when hydrophilic binding agents are used for laminating (glue-bonding or adhesive bonding with the base) the impregnated papers do not occur. This means that the impregnation resin solution described herein may be used to produce prepregs that lend themselves well to lamination.

A further advantage consists in that the prepreg may be produced inexpensively and at high machine speeds.

DETAILED DESCRIPTION

In this description, "prepreg" is understood to mean papers that are impregnated with resin. The proportion of impregnation resin in the prepreg may preferably be 10 to 35% by weight, but particularly 12 to 30% by weight relative to the grammage of the decorative base paper.

The decorative base papers to be impregnated are papers that have not undergone any internal or surface sizing treatments. They consist essentially of wood pulp, pigments, fillers and other additives. Usual additives may be wet strength enhancers, retention agents, and fixers. Decorative base papers differ from usual papers by the much higher content of fillers and higher pigment content, and the fact that they have not been subjected to internal or surface sizing.

The styrene-alkylacrylate-hydroxyethyl(meth)acrylate copolymer used according to this description may be introduced in the form of a latex or a dispersion into the impregnation resin liquid. Without being bound by theory, the presence of hydroxyethyl(meth)acrylate (HEMA) in the copolymer may be responsible for the advantageous effects described here when compared with other styrene-alkylacrylates.

The proportional quantity of the hydroxyethyl(meth)acrylate in the styrene-alkylacrylate-hydroxyethyl(meth)acrylate copolymer may preferably be from 0.5 to 20% by weight relative to the mass of the acrylate fraction, particularly 1 to 10% by weight. It has proven particularly advantageous if the fraction of the co-monomer used according to an embodiment of the invention that is between 3 and 8% by weight.

The alkyl in the styrene-alkylacrylate is preferably an ethyl or butyl, i.e., ethylacrylate or butylacrylate. Copolymers may be used as mixtures of these alkyl groups in the alkylacrylate fraction.

It is particularly preferred if the copolymer used according to one embodiment of the invention has a glass transition temperature (TG) from 35 to 50° C.

The water-soluble polymer used according to one embodiment of the invention in the impregnation resin is preferably starch or a starch dextrin.

A preferred starch dextrin or modified starch of one embodiment may have a molecular weight distribution, expressed by a polydispersity index Mw/Mn, of at least 6. Starches that have a polydispersity index from 6 to 20 are preferred. In one particular variant, a modified starch preferably has the following molecular weight distribution of starch molecules:

- not more than 6% by weight of molecules having a molecular weight from 0 to 1,000 g/mol,
- 5 to 20% by weight of molecules having a molecular weight between 1,000 and 5,000 g/mol,
- 20 to 40% by weight of molecules having a molecular weight between 5,000 and 25,000 g/mol,
- 20 to 45% by weight of molecules having a molecular weight between 25,000 and 200,000 g/mol,
- 5 to 22% by weight of molecules having a molecular weight between 200,000 and 1,000,000 g/mol,
- 0.5 to 5% by weight of molecules having a molecular weight greater than 1,000,000 g/mol.

Such a modified starch is available commercially. The polydispersity index is usually expressed as the ratio between the weight-average and the number-average molar mass Mw/Mn. It provides information about the width of the molecular weight distribution curve.

The molecular weight distribution of modified starches was determined in the normal way by the starch manufacturer using gel permeation chromatography (GPC). The GPC analysis was performed using a chromatograph with Shodex KS columns. The eluent was 0.05 M NaOH at a flow through rate of 1 ml/min. Calibration was carried out using pullulan standards having known molecular weights.

The proportion of water-soluble polymer/polymer latex in the impregnation resin solution is preferably from 80/20 to 20/80, wherein a proportion of 45/55 to 65/35 and particularly 50/50 to 60/40 relative to the mass of the impregnation resin (atro) is preferred. The water-soluble polymer is preferably selected from starches or starch derivatives, particularly starch dextrin, which can be produced from renewable raw materials. According to another embodiment of the invention, polyvinyl alcohol may be used additionally.

The impregnated resin solution may contain pigments and/or fillers. The quantity of the pigment and/or filler may be from 1 to 30% by weight, particularly 2 to 20% by weight. Quantities are given relative to the mass of the binder (bone dry). For the present purposes, the term binder is used to describe the mixture containing the polymer latex and the water-soluble polymer.

The impregnation resin solution used to manufacture the prepregs according to some embodiment of the invention has a total solid content relative to dry weight from 9 to 40% by weight, preferably 20 to 35% by weight, and particularly preferably 26 to 30% by weight.

In order to produce the impregnation resin solution, first the starch may be prepared, either cold, that is to say it is dissolved in water at room temperature up to a temperature not exceeding 60° C., or it is boiled at about 120 to 145° C. This produces a 40 to 45% suspension with a pH value of about 5 to 6. In the next step, an approximately 50% latex dispersion with a pH value from 5 to 10 is added, taking into account the desired solid content and starch/latex ratio. In a further step, pigment or filler may be added.

The base paper to be impregnated, according to one embodiment of the invention, may contain a large fraction of a pigment or filler. The percentage of filler in the base paper may be up to 55% by weight, particularly 8 to 45% by weight relative to the grammage (basis weight). Suitable pigments and fillers are for example titanium dioxide, talcum, zinc sulphide, kaolin, aluminium oxide, calcium carbonate, corundum, silicates of aluminium and magnesium, or mixtures thereof.

The wood pulp content used for producing the base papers may be softwood pulps (long fibre pulps) and/or hardwood pulps (short fibre pulps). Cotton fibres and mixtures thereof with the aforementioned wood pulp types may also be used. For example, a mixture of softwood and hardwood pulps in ratios from 10:90 to 90:10, particularly from 20:80 to 80:20 is particularly preferred. However, the use of 100% by weight hardwood pulp has also proven advantageous. Percentages refer to the mass of the pulps (bone dry).

The pulp mixture may preferably contain cationically modified pulp fibres in a quantity of at least 5% by weight relative to the weight of the pulp mixture. A proportion from 10 to 50% by weight, particularly 10 to 20% by weight of the cationically modified wood pulp in the wood pulp mixture has proven particularly advantageous. The cationic modification of the pulp fibres may be carried out by reacting the fibres with an epichlorhydrin resin and a tertiary amine, or in a reaction with quaternary ammonium chlorides such as chlorohydroxypropyl trimethylammonium chloride or glycidyl trimethyl ammonium chloride. Cationically modified wood pulps and the production thereof are known for example from the publication DAS PAPIER, vol. 12 (1980), pp. 575-579.

The base papers may be produced on a Fourdrinier paper machine or a Yankee paper machine. For this, the wood pulp mixture may be ground with a stock consistency of 2 to 5% by weight to a grinding degree of 10 to 45° SR. The bulking agents such as titanium dioxide and talcum, and the wet strength enhancer may be added to the wood pulp mixture and mixed thoroughly in a mixing chest. The highly viscous substance obtained may be diluted to a stock consistency of about 1%, and if necessary further adjuvants such as retention agents, antifoaming agents, aluminium sulphate and other auxiliary substances listed previously may be added. This thin stock is passed to the wire section via the headbox of the paper machine A non-woven sheet of fibres is formed, and after dewatering the base paper is obtained and subsequently dried. The grammages of the papers produced may be from 15 to 300 g/m$^2$. However, base papers with a weight per unit area of 40 to 100 g/m$^2$ are preferred.

The impregnation resin solution to be used according to one embodiment of the invention may be applied in the paper machine or offline by spraying, impregnation, roller application or blade applicator (doctor blade). Application using a size press or a film press is particularly preferred.

The impregnated papers are dried in the usual way using IR or roller driers in a temperature range from 120 to 180° C. until a residual moisture content of 2 to 6% is reached.

After drying, the papers impregnated in this way (prepregs) may be printed and varnished, and then laminated onto various substrates, such as chipboard or fibreboard using standard methods.

The following examples will serve to provide greater detail. The examples are presented to illuminate, illustrate and provide additional descriptions of the invention in addition to those above, in the form of describing several embodiments of the invention. The examples are not intended to limit the scope of the description or claims unless specifically specified and described as such in the claims. Unless indicated otherwise, values given in percentage by weight refer to the weight of the wood pulp. The proportion means the ratio of masses or the weight ratio.

EXAMPLES

Example V-1 (Comparison)

A wood pulp suspension was prepared by grinding a wood pulp mixture of 80% by weight eucalyptus pulp and 20% coniferous wood sulphate pulp with a stock consistency of 5% to a grinding degree of 33° SR (Schopper-Riegler). Then, 1.8% by weight epichlorohydrin resin was added as a wet strength enhancer. This wood pulp suspension was adjusted to a pH value of 6.5 with aluminium sulphate. After that, a mixture of 30% by weight titanium dioxide and 5% by weight talcum, 0.11% by weight of a retention agent and 0.03% by weight of an antifoaming agent was added to the wood pulp suspension and a decorative base paper with a weight per unit area of about 50 g/m$^2$ and an ash content of about 23% by weight was produced. Weight information refers to the weight of the wood pulp (atro).

This base paper was impregnated on both sides with an aqueous resin solution of about 25% by weight solid content containing starch dextrin (EMDEX® B1102, manufactured by Emsland-Stärke, Emlichheim) and styrene-butylacrylate copolymer latex (PLEXTO1® X4340, manufactured by Polymer Latex, Marl) in a ratio of 55:45 in a size press. For this, first a feedstock of 45% starch dextrin was prepared and diluted with water to a concentration of 25% by weight. Them the matching quantity of the 50% aqueous polymer dispersion was added and the polymer solution obtained was diluted with water to a solid content of 30% by weight and adjusted to a pH of 8.0 with caustic soda.

The impregnated paper was then dried at a temperature of about 120° C. until its residual moisture reached a level of 2.5%. The quantity of impregnating resin solution for application after drying was 10 g/m$^2$.

The glass transition temperature Tg of the latex (copolymer) used, PLEXTOL® X4340, is 28° C.

Example A-1 (Embodiment)

The base paper produced as described in Example V-1 was impregnated in a size press with an aqueous resin solution having a solid content of 25%, containing starch dextrin EMDEX® B1102 and a latex trial product 1, which was manufactured in the same way as PLEXTOL® X4340, but in which 3% of the butyl acrylate was replaced with hydroxyethyl methacrylate (HEMA), in a ratio of 55:45. The styrene-butylacrylate-(hydroxyethyl methacrylate)-latex has a glass transition temperature Tg of 36° C.

Example B-1 (Embodiment)

The base paper produced as described in Example V-1 was impregnated in a size press with an aqueous resin solution having a solid content of 25%, containing starch dextrin EMDEX® B1102 and a latex trial product 2, which was manufactured in the same way as PLEXTOL® X4340, but in which 6% of the butyl acrylate was replaced with hydroxyethyl methacrylate (HEMA), in a ratio of 55:45. The styrene-butylacrylate-hydroxyethyl methacrylate-polymer has a glass transition temperature Tg of 40° C.

Example B-2 (Embodiment)

The prepreg was produced in the same way as prepreg B-1, but the ratio of starch dextrin to latex trial product 2 in the impregnation resin solution was 40:60.

Example B-3 (Embodiment)

The prepreg was produced in the same way as prepreg B-1, but the ratio of starch dextrin to latex trial product 2 in the impregnation resin solution was 25:75.

Example C-1 Through C-3

The prepregs were produced in the same way as Examples B-1 through B-3, but the latex used was trial product 3 obtained from Polymer Latex, Marl. Latex trial product 3 is based on a styrene-ethylacrylate-polymer, with 6% of the ethylacrylate monomer replaced by hydroxyethyl methacrylate (HEMA). The styrene-ethylacrylate-(hydroxyethyl methacrylate)-latex has a glass transition temperature Tg of 39° C. The impregantion resin solutions used had a latex to starch dextrin ration of 45:55 for example C-1, 60:40 for examples C-2 and 75:25 for example C-3

Example V-2 (Comparison)

The base paper produced as described in Example V-1 was impregnated in a size press with an aqueous resin solution having a solid content of 25%, containing starch dextrin EMDEX® B1102, polyvinyl alcohol MOWIOL® 4-98 (manufactured by Kuraray Europe GmbH, Frankfurt) and latex PLEXTOL® X4340, in a ratio of 40:15:45.

First a 45% starch dextrin formulation and a 10% MOWIOL® formulation prepared correspondingly were mixed with the above. Then the corresponding quantity of 50% aqueous polymer dispersion was added and the polymer solution obtained was diluted with until the solid content was 30% by weight, and adjusted to pH 8.0 with caustic soda.

Example A-2 (Embodiment)

The base paper produced as described in Example V-1 was impregnated in a size press with an aqueous resin solution having a solid content of 25%, containing starch dextrin EMDEX® B1102, polyvinyl alcohol MOWIOL® 4-98 and latex trial product 1, in a ratio of 40:15:45.

Example B-4 (Embodiment)

The base paper produced as described in Example V-1 was impregnated in a size press with an aqueous resin solution having a solid content of 25%, containing starch dextrin EMDEX® B1102, polyvinyl alcohol MOWIOL® 4-98 and latex trial product 2, in a ratio of 40:15:45.

Example B-4 (Embodiment)

The base paper produced as described in Example V-1 was impregnated in a size press with an aqueous resin solution having a solid content of 25%, containing starch dextrin EMDEX® B1102, polyvinyl alcohol MOWIOL® 4-98 and latex trial product 2, in a ratio of 10:15:75.

Table 1 shows the results of various treatments and the results of tests of various papers described in the Table. The following properties were tested:

Ply Bond Strength (Parameter for Resistance to Splitting)

The measurement was taken on the prepreg with the aid of the emco IBT Internal Bond Tester (manufactured by emco GmbH, Leipzig, Germany) in accordance with the standardised test method TAPPI 833-om 94. The material to be tested is cut into a 1-inch wide strip and attached between an anvil and 5 aluminium brackets by adhesion using double-sided adhesive tape, and compressed in the compression mechanism for a defined compression time and with a defined compression force. Five samples are placed in the sample holder of the impact mechanism simultaneously and subjected to an impact force with a weight of 30 kg.

Dry Breaking Strength and Wet Breaking Strength

Measurement was performed on the prepreg in accordance with DIN-EN-ISO-1924 T2.

The test of bond strength and the TESA test are performed on varnished samples of the prepreg that have been laminated onto a chipboard panel.

Varnish of the Prepreg

The prepreg samples are preheated for 60 seconds at 160° C. Then, 10±1 g/m$^2$ of the acid-hardening varnish system IV-49 manufactured by Plantagchemie, Detmold, is spread over them with a doctor blade. The samples are dried by laying them horizontally in a drying kiln for 45 seconds at 160° C.

Lamination of the Prepreg

The varnished prepreg is attached to a chipboard panel using a laboratory laminating calender. Standard commercial chipboard panels (20×20 cm) are used. A urea-resin-glue solution (Kaurit Leim 122 manufactured by BASF AG, Ludwigshafen, powder dissolved in water with 50% solid content) is applied to one side of the chipboard panel with a doctor knife, the glue application is 35±5 g/m$^2$ relative to solid content. The varnished prepreg sheet is placed on top of the sized chipboard surface, the varnished side of the sheet facing away from the chipboard and the sheet protruding about 2 cm beyond the edges of the chipboard on all sides. The chipboard panel with the varnished prepreg is then pushed through the laminating calender, where a contact pressure of 80N/mm is applied, the temperature of the compression rollers is 180° C., and the feed speed is 2 m/min.

Adhesive Strength

The test of adhesion begins immediately after lamination. For this purpose, the approximately prepreg strip, extending about 2 cm over the sides of the chipboard panel is cut perpendicularly to the edge of the panel. The width of the strips and their distance from each other are both 12 mm.

Each protruding strip is drawn sharply over a triangular bar by hand at an angle of 60° to the chipboard panel. This tugging test is carried out immediately following lamination, and then repeated after a further 2 minutes, 5 minutes, 10 minutes, 30 minutes and 24 hours. The area that is no longer or no longer completely covered by the prepreg after the tugging operations is evaluated. The evaluation is recorded in the form of scores (score 1=very good to score 6=unsatisfactory).

TESA Test

The TESA test is carried out on the basis of company standard IHD-W-463 of the Institut für Holztechnologie Dresden. First, the laminated panels are stored for 24 h. Then, TESA film strips (TESA film type 4104) approximately 15 cm. wide are applied to the laminated panel in the feed direction of the laminating calender and perpendicularly thereto and rendered bubble-free with a test roller (10 kg). The TESA strips are torn off sharply by hand at an angle of 30° at several different times (immediately, 1 h, 2 h). The area below the torn off test strip is evaluated, ideally the paper does not split. The evaluation of TESA resistance is recorded in the form of scores (score 1=very good to score 6=unsatisfactory).

The results of the tests shown in table 1 show that increasing the hydroxyethyl methacrylate content in the styrene-alkylacrylate polymer in the impregnation resin solution from 0% by weight to 3% by weight, and further to 6% by weight, relative to the acrylate fraction in each case, also causes increases in the structural strength and the dry and wet breaking strengths of the prepreg, and at the same time improves the adhesion of the prepreg to the chipboard panel, and TESA resistance is also improved. This improvement is obtained both when starch dextrin is used as the water-soluble polymer and when mixtures of starch dextrin and polyvinyl alcohol are used as such. A further increase may be realised by raising the proportion of the styrene-alkyl acrylate hydroxyethyl methacrylate copolymer.

2. The prepreg of claim 1, wherein the fraction of hydroxyethylmethacrylate is 1 to 10% by weight relative to the mass of the acrylate component.

3. The prepreg of claim 1, wherein the styrene-alkylacrylate-hydroxyethyl-(meth)acrylate copolymer is a styrene-ethylacrylate- hydroxyethylmethacrylate copolymer or a styrene-butylacrylate-hydroxyethylmethacrylate copolymer.

4. The prepreg of claim 1, wherein the copolymer has a glass transition temperature from 35 to 50° C.

5. The prepreg of claim 1, wherein the water-soluble polymer is starch dextrin.

6. The prepreg of claim 1, wherein the ratio of water-soluble polymer to copolymer is from 30:70 to 80:20 relative to the mass of impregnating resin (bone dry).

7. The prepreg of claim 1, wherein the impregnating resin solution contains 1 to 30% by weight of a pigment and/or filler relative to the mass of the binding agent (bone dry).

8. The prepreg of claim 7, wherein the pigment is selected from the group consisting of: titanium dioxide, kaolin, bentonite, calcium carbonate or any combination thereof.

9. The prepreg of claim 1, wherein the impregnating resin solution has a solid content of 9 to 40% by weight.

10. The prepreg of claim 1, wherein the mass of the impregnating resin in the prepreg, calculated as a dry substance, is 10 to 35% of the grammage of the decorative base paper.

11. The prepreg of claim 1, wherein additional impregnating resin solution is thoroughly applied to the prepreg in order to make a decorative paper or decorative coating material.

12. The prepreg of claim 1, comprising a decorative base paper partially impregnated with an impregnating resin solution, wherein,

| | Latex Plextol X4340 Tg = 28° C. %/wt (bone dry) | Latex trial product 1 3% HE-MA Tg = 36° C. %/wt (bone dry) | Latex trial product 2 6% HEMA Tg = 40° C. %/wt (bone dry) | Latex trial product 3 6% HEMA Tg = 39° C. | Dextrin EMDEX B1102 %/wt (bone dry) | PVA Mowiol 4-98 %/wt (bone dry) | Ply bond strength J/m2 | Dry breaking strength MD/CD N/mm$^2$ | Wet breaking strength MD/CD N/mm$^2$ | Adhesion UF glue Score | TESA test 2 h Score |
|---|---|---|---|---|---|---|---|---|---|---|---|
| V-1 | 45 | | | | 55 | 0 | 1420 | 68/38 | 25/23 | 3 | 4 |
| A-1 | | 45 | | | 55 | 0 | 1560 | 71/40 | 27/23 | 2 | 3 |
| B-1 | | | 45 | | 55 | 0 | 1620 | 74/42 | 30/25 | 1 | 2 |
| B-2 | | | 60 | | 40 | 0 | 1860 | 76/41 | 38/29 | 1 | 1 |
| B-3 | | | 75 | | 25 | 0 | 2020 | 75/40 | 56/32 | 2 | 1 |
| C-1 | | | | 45 | 55 | 0 | 1650 | 75/41 | 31/27 | 1 | 2 |
| C-2 | | | | 60 | 40 | 0 | 1800 | 76/43 | 39/30 | 2, 5 | 1 |
| C-3 | | | | 75 | 25 | 0 | 2100 | 73/42 | 54/33 | 4 | 1 |
| V-2 | 45 | | | | 40 | 15 | 1300 | 67/35 | 25/22 | 2 | 4 |
| A-2 | | 45 | | | 40 | 15 | 1420 | 69/41 | 23/24 | 1 | 2, 5 |
| B-4 | | | 45 | | 40 | 15 | 1510 | 70/41 | 26/22 | 1 | 2 |
| B-5 | | | 75 | | 10 | 15 | 2000 | 77/39 | 54/33 | 1 | 1 |

Table 1 above shows the composition of impregnating resin solution and test results.

I claim:

1. A prepreg comprising a decorative base paper partially impregnated with an impregnating resin solution, wherein the impregnating resin solution contains at least one styrene-alkylacrylate-hydroxyethyl-(meth)acrylate copolymer and at least one water-soluble polymer, selected from starch or a starch derivative, wherein alkylacrylate is selected from the group consisting of methylacrylate, ethylacrylate, propylacrylate, or butylacrylate or mixtures thereof; and wherein the styrene-alkylacrylate-hydroxyethyl(meth)-acrylate copolymer contains a fraction from 0.5 to 20% by weight hydroxyethylmethacrylate relative to the weight of the acrylate component.

the impregnating resin solution contains at least one styrene-alkylacrylate-hydroxyethyl-(meth)acrylate copolymer and at least one water-soluble polymer, selected from starch or a starch derivative, wherein alkylacrylate is selected from the group consisting of: methylacrylate, ethylacrylate, propylacrylate, or butylacrylate;

the styrene-alkylacrylate-hydroxyethyl(meth)-acrylate copolymer contains a fraction from 0.5 to 20% by weight hydroxyethylmethacrylate relative to the weight of the acrylate component;

the copolymer has a glass transition temperature from 35 to 50° C.;

the ratio of water-soluble polymer to copolymer is from 30:70 to 80:20 relative to the mass of impregnating resin;

the impregnating resin solution contains 1 to 30% by weight of a pigment and/or filler relative to the mass of the binding agent; and the impregnating resin solution has a solid content of 9 to 40% by weight.

13. The prepreg of claim 12, wherein, said styrene-alkylacrylate-hydroxyethyl-(meth)acrylate copolymer is a styreneethylacrylate- hydroxyethylmethacrylate copolymer or a styrene-butylacrylate-hydroxyethylmethacrylate copolymer;

said styrene-alkylacrylate-hydroxyethyl(meth)-acrylate copolymer contains a fraction from 1 to 10% by weight hydroxyethylmethacrylate relative to the weight of the acrylate component; and said water-soluble polymer is selected from the group consisting of: a starch, starch derivative, starch dextrin, or any combination of thereof.

14. The prepreg of claim 13, wherein, said styrene-alkylacrylate-hydroxyethyl(meth)-acrylate copolymer contains a fraction from 3 to 8% by weight hydroxyethylmethacrylate relative to the weight of the acrylate component;

said pigment is selected from the group consisting of: titanium dioxide, kaolin, bentonite, calcium carbonate or any combination thereof and said mass of the impregnating resin in the prepreg, calculated as a dry substance, is 10 to 35% of the grammage of the decorative base paper.

15. A decorative paper or decorative coating material comprising a decorative base paper thoroughly impregnated with an impregnating resin solution, wherein the impregnating resin solution contains at least one styrene-alkylacrylate-hydroxyethyl -(meth)acrylate copolymer and at least one water-soluble polymer, wherein alkylacrylate is selected from the group consisting of: methylacrylate, ethylacrylate, propylacrylate, or butylacrylate or mixtures thereof; and wherein the styrene-alkylacrylate -hydroxyethyl(meth)-acrylate copolymer contains a fraction from 0.5 to 20% by weight hydroxyethylmethacrylate relative to the weight of the acrylate component.

16. A process for manufacturing a prepreg, the process comprising partially impregnating a decorative base paper with an impregnating resin solution, wherein the impregnating resin solution contains at least one styrene-alkylacrylate-hydroxyethyl-(meth)acrylate copolymer and at least one water-soluble polymer, selected from starch or a starch derivative, wherein alkylacrylate is selected from the group consisting of: methylacrylate, ethylacrylate, propylacrylate, or butylacrylate or mixtures thereof; and wherein the styrene-alkylacrylate-hydroxyethyl(meth)-acrylate copolymer contains a fraction from 0.5 to 20% by weight hydroxyethylmethacrylate relative to the weight of the acrylate component.

17. A process for manufacturing a decorative paper or decorative coating material, the process comprising thoroughly impregnating a decorative base paper with an impregnating resin solution, wherein the impregnating resin solution contains at least one styrene-alkylacrylate-hydroxyethyl-(meth)acrylate copolymer and at least one water-soluble polymer, selected from starch or a starch derivative, wherein alkylacrylate is selected from the group consisting of: methylacrylate, ethylacrylate, propylacrylate, or butylacrylate or mixtures thereof: and wherein the styrene-alkylacrylate-hydroxyethyl(meth)-acrylate copolymer contains a fraction from 0.5 to 20% by weight hydroxyethylmethacrylate relative to the weight of the acrylate component.

* * * * *